United States Patent [19]

Carella et al.

[11] 4,054,307

[45] Oct. 18, 1977

[54] MECHANICAL CONTROL SYSTEM FOR VEHICLE DOOR LOCK

[75] Inventors: Richard F. Carella, Mount Clemens, Mich.; Thomas W. Perry, South Bend, Ind.

[73] Assignee: General Motors Corporation, Detroit, Mich.

[21] Appl. No.: 739,564

[22] Filed: Nov. 8, 1976

[51] Int. Cl.[2] ..... E05C 7/00

[52] U.S. Cl. ..... 292/50; 292/336.3; 292/DIG. 25

[58] Field of Search ..... 292/336.3, DIG. 25, 292/DIG. 43, DIG. 5, 38, 50, 347, 52, 40, 29

[56] References Cited

U.S. PATENT DOCUMENTS

| | | | |
|---|---|---|---|
| 1,704,164 | 3/1929 | Buckney | 292/50 |
| 2,237,658 | 4/1941 | Dyke | 292/1 |
| 2,512,804 | 6/1950 | McDonald | 70/146 |
| 2,917,770 | 12/1959 | Etnyre | 292/DIG. 25 |
| 3,069,889 | 12/1962 | Johnstone et al. | 70/147 |
| 3,858,922 | 1/1975 | Yamanaka | 292/336.3 |

FOREIGN PATENT DOCUMENTS

| | | | |
|---|---|---|---|
| 822,405 | 10/1959 | United Kingdom | 292/DIG. 25 |

*Primary Examiner*—Richard E. Moore
*Attorney, Agent, or Firm*—Charles E. White

[57] ABSTRACT

This mechanical control system for vehicle door closure locks incorporates a remote interior handle, supported by a vehicle door, manually movable in a first plane for effecting the locking function of the door lock mechanism and manually movable in a second plane for effecting the latching function of the lock mechanism. The system encompasses the interconnection of remote handles for spaced doors so that the handle of either door may be selectively used to control the locking function of both door locks.

5 Claims, 5 Drawing Figures

MECHANICAL CONTROL SYSTEM FOR VEHICLE DOOR LOCK

This invention relates to door lock control systems and more particularly to a new and improved remote control system for vehicle door locks having a manual lever movable in different planes for selectively effecting the latching and locking functions of vehicle door lock mechanism. This system further relates to the interconnection of remote handle assemblies for door locks on spaced doors so that the manual actuation of either handle will control the locking function of both door locks.

Mechanical control systems for actuating vehicle door locks prior to this invention often employ separate mechanical devices for controlling the latching and locking function of the lock. Usually an inside remote handle is provided to control the unlatching of the door bolt from its keeper so that the door can be moved from a closed position to an open position. A garnish button separate from the remote handle is employed to control the locking function of the door lock by providing for keyless locking. In the event that an operator or passenger desires to unlock a door remote from the adjacent door a physical shifting, leaning and stretching of the body of often required for manual manipulation of the remote garnish button.

In contrast to the prior art, this invention employs a single manual lever to readily control both the latching and locking function of a conventional door lock assembly. With the garnish button being eliminated, this invention offers a new and improved manual control system for vehicle door locks that is easier and more convenient to operate and which is substantially reduced in complexity and costs as compared to many prior art systems. It is further more flexible than prior art systems and can be readily extended so that the door locks for left and right side doors can be mechanically interconnected to provide for locking and unlocking from either remote handle. While the system inorporates latching and locking controls from a remote handle, the latching function may be eliminated so that either handle can be employed to control only the locking and unlocking function of the spaced door. When the latching function is included in the system, the unlatching of one door by a remote handle will not trigger the unlatching of the remote door.

Another feature, object and advantage of this invention is to provide a new and improved control system for controlling the locking and latching function of a vehicle door lock which incorporates a single manual operator that can be moved in one plane to effect the locking and unlocking function of the door lock and moved in a second plane, at an angle to the first plane, to effect the unlatching of the door to permit it to be swung from a closed to an open position.

Another feature, object and advantage of this invention is to provide a new and improved manual control system for spaced doors of a vehicle in which the locking and latching function of each door lock is controlled by a remote handle assembly mounted on each door; the handle assemblies are interconnected so that the locking and unlocking of both doors is controlled by either remote handle.

Another feature, object and advantage of this invention is to provide a new and improved manual control system for controlling the locking assembly of left and right side doors which incorporates a single operator mechanism on each door which controls the locking and unlocking of the lock assembly of both doors.

Another feature, object and advantage of this invention is to provide a new and improved manual control system for controlling the locking and latching function of door locks on spaced side doors of a vehicle; the control system includes a remote handle and an actuator plate on each door, operatively connected to respective door locks and interconnected by cable means operable under tension so that rotation of one actuator plate results in rotation of the other actuator plate for the simultaneous locking or unlocking of both doors from either remote manual handle.

These and other objects, features and advantages of this invention will become more apparent from the following detailed description and drawings in which.

Figure 1:
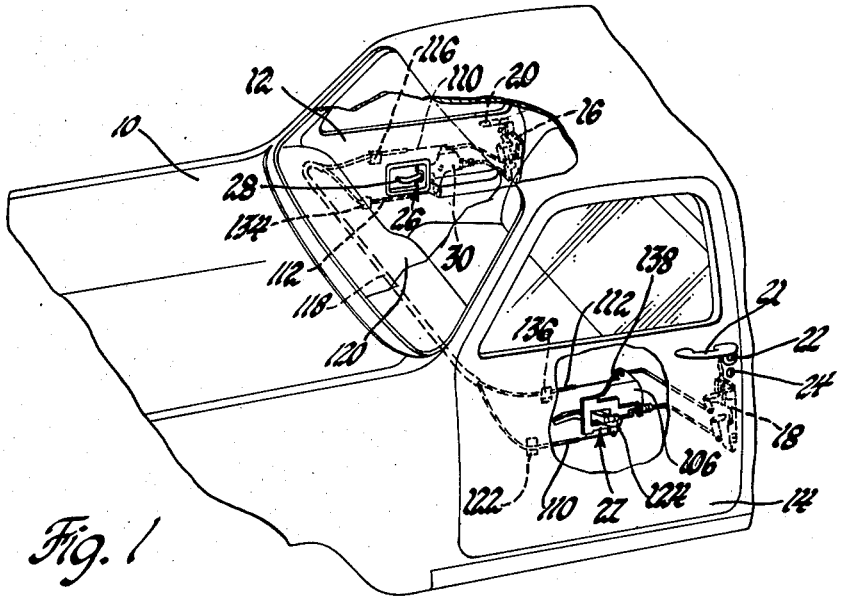
FIG. 1 is a perspective view of a portion of an automotive vehicle illustrating a remote control system for the locks of the side doors thereof.

Turning now in greater detail to the drawings, FIG. 1 shows a portion of vehicle body 10 having right and left side doors 12 and 14 which are movable with respect to the body between the illustrated closed position and an open position. The doors are respectively retained in their closed position by suitable vehicle body door closure locks 16 and 18 such as those more fully disclosed in U.S. Pat. No. 3,190,682 to Fox et al. issued June 22, 1965 whose disclosure is hereby incorporated by reference.

Mounted on the outside of door 12 is a fixed handle 20 including conventional push button lock operating means operatively connected to the body door closure lock 16. Also, a conventional outside key lock cylinder is employed on door 12 for placing the door lock 16 in either a locked or unlocked condition. Door 14 has the same corresponding outside door handle 21, push buttom 22 and cylinder lock construction 24 as door 12. Left and right side interior remote control handle assembles 26 and 27 for locks 16 and 18 respectively are substantially the same in construction and operation so that only one remote control handle assembly is described in detail.

Figure 2:
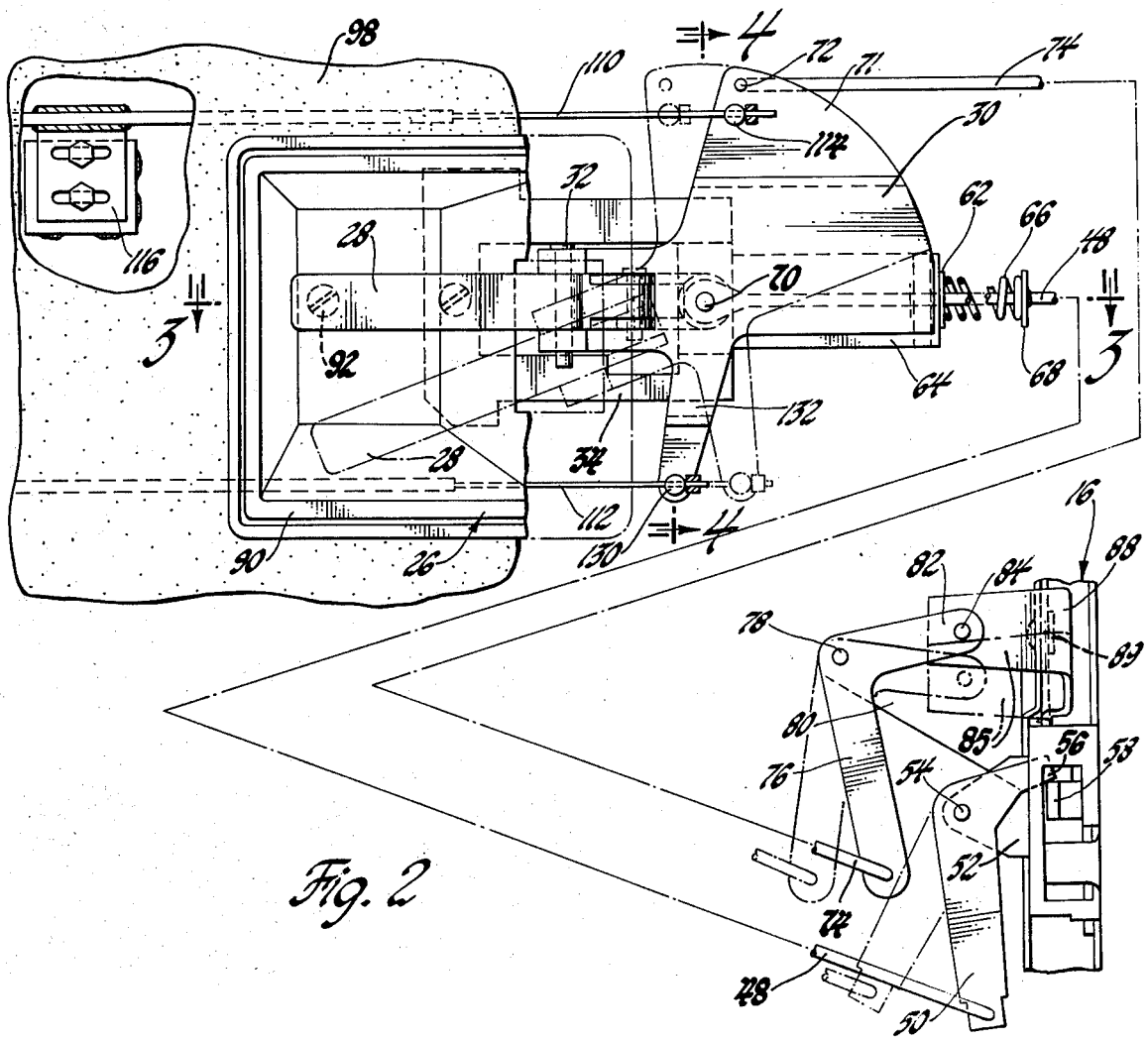
FIG. 2 is a side elevational view of a portion of the system of FIG. 1 operatively connected to a conventional door lock assembly.
Figure 3:
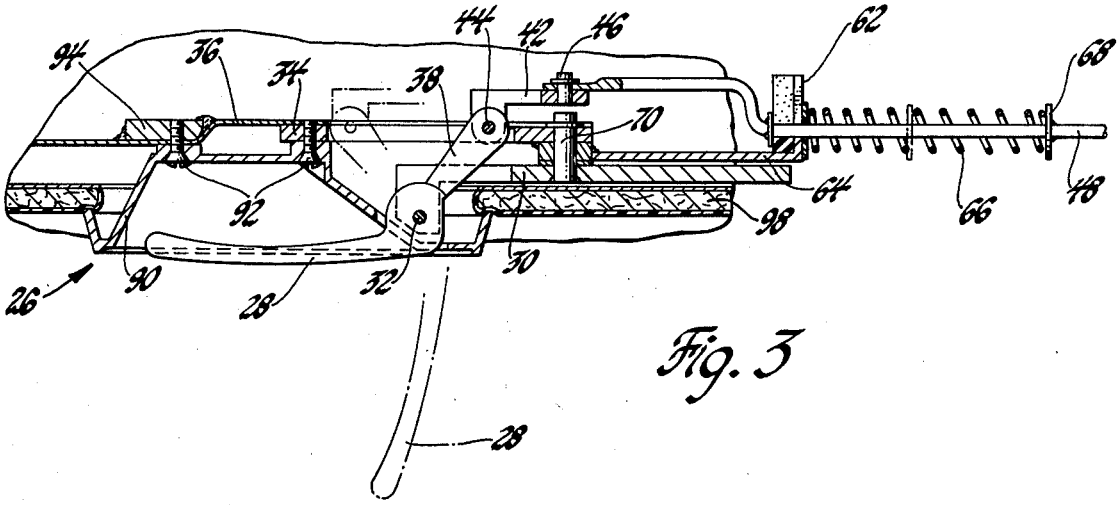
FIG. 3 is a view taken generally along line 3—3 of FIG. 2.
Figure 4:
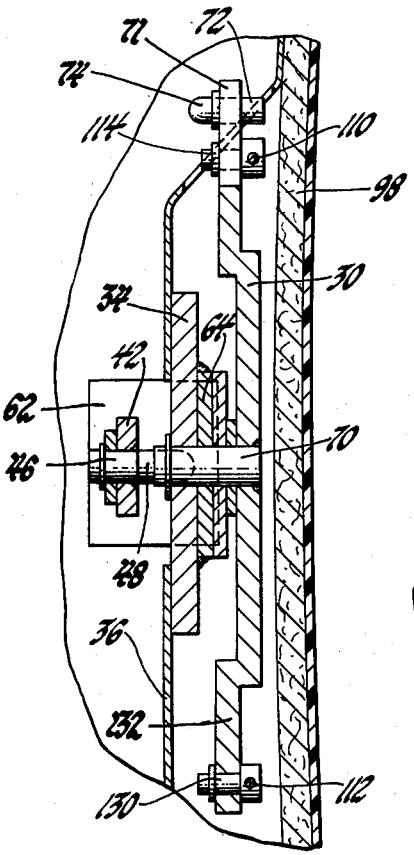
FIG. 4 is a view taken along line 4—4 of FIG. 2.
Figure 5:
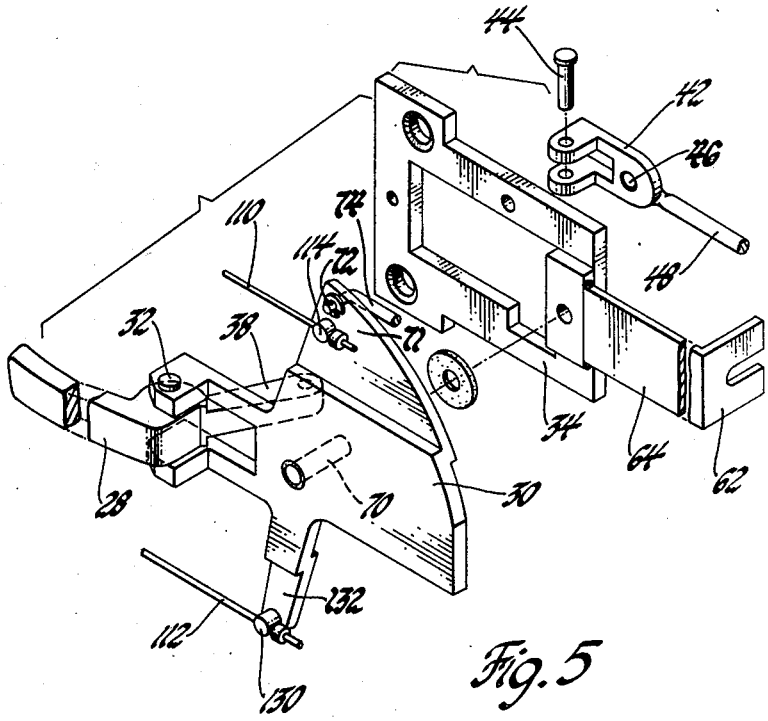
FIG. 5 is an exploded perspective view of the remote handle assembly of this invention.

More particularly, the lock 16 is controlled from the interior of the vehicle through the remote control handle assembly 16 which is mounted on the interior of the right side door 12 in a location convenient to the vehicle passenger. As best shown in FIGS. 2, 3 and 5, the remote handle assembly 26 comprises a movable manual handle 28 that is mounted on an enlarged actuator plate 30 by vertical pivot pin 32 for turning movement in a plane generally at right angles to the door. The actuator plate 30 is in turn pivotally supported on a fixed mounting plate 34 that is secured to an interior panel 36 of the door. The manual handle 28 has an extending lever arm 38 that projects into the interior of the door and terminates in a distal end portion pivoted to a pair of spaced projections of a movable yoke 42 by vertically arranged pivot pin 44.

Pivot pin 44 interconnects lever arm 38 and yoke 42 so that turning movement of the remote handle 28 to the phantom line position in FIG. 3 effects translatory movement of the yoke 42 to the corresponding phantom line position illustrated. The end of yoke 42 is coupled by horizontal pivot pin 46 to a connecting rod 48 that extends internally of the door 12 onto pivotal engagement with one end of a crank 50 that is mounted to a support tab 52 struck from lock 16 by a pivot 54. The crank 50 has an arm 56 that engages the end of a detent lever 58 of the lock 16 and is operative to swing the detent to effect unlatching of the door. This action is more fully described in the above-referenced patent to Fox et al. in which lever 158 corresponds to the crank 50 of the preferred embodiment of this invention.

As rod 48 extends from yoke 42, it projects through the bifurcated end 62 of a rod support and guide plate 64 which has a based welded or otherwise secured to the mounting plate 34. A helical spring 66 interposed between the bifurcated end 62 of plate 64 and a spring seat 68 secured to the rod, normally biases the handle 28 and crank 50 to their full line positions of FIGS. 2 and 3.

While remote handle 28 is capable of operating the crank 50 to permit the door to be unlatched and pivoted on its hinges to an open position, this invention importantly provides for the bolting or locking of the door through the selective manual manipulation of remote handle 28. To this end, it will be seen that the actuator plate 30 is supported for turning movement on the mounting plate 34 by pivot pin 70. This construction permits the handle 28 and connected actuator plate 30 to be generally turned in the plane of the door for selectively locking or unlocking door 12.

As best shown in FIGS. 1 and 2, the upper extremity 71 of actuator plate 30 is drivingly connected to one end 72 of a locking rod 74 that extends between the inner and outer panels of the door 12 and into engagement with a crank member 76 of lock 16. The crank member 76 is mounted by pivot 78 to a support bracket 80 projecting from the body of lock 16. The crank member 76 has an arm 82 which is connected by pivot 84 to an angularly disposed end portion 85 of a locking lever 88 corresponding to the locking lever 112 of the Fox et al. patent referenced above. When the locking lever 88 is turned on its pivot 89 by appropriate movement of the handle 28 to the phantom line position shown in FIG. 2, keyless locking is accomplished. A suitable linkage, not shown, operatively connects the key cylinder 24 to the crank 76 so that the locking lever 88 can be readily operated by a key from the outside for door locking and unlocking functions.

To facilitate manual operation of handle 28 and to provide a finely finished appearance, a dished rectangular thin walled escutcheon 90 is provided. This escutcheon is secured by screws 92 to tapping plate 94 and an inner panel 36 of the vehicle door. The peripheral edges of the escutcheon fit over the peripheral edges of the opening in the interior finish panel 98 as illustrated in FIG. 3 to provide a continuous surface and an attractive appearance.

To permit the simultaneous mechanical locking and unlocking of doors 12 and 14 from the inside of the vehicle, the right and left side remote handle assemblies 26 and 27 are interconnected. For such control, actuator plate 30 of right side handle assembly 26 is operatively connected to the corresponding actuator plate 106 of the left side remote handle assembly by a pair of cables 110 and 112. As best shown in FIG. 2, the right side upper cable 110 extends from connector 114 secured to the upper extremity 71 of actuator plate 30 through cable support and guide bracket 116, tubular piping 118 beneath the instrument panel 120, support and guide bracket 122 in the left side door 14 into engagement with a connector on the lower extremity 124 on the left side actuator plate 106. The right side lower cable 112 extends from a connector 130 on the end of a downwardly projecting or lower extremity 132 of the actuator plate 30 through cable support and guide bracket 134 on the left side door through the tubing 118, a support and guide bracket 136 on the right hand door and into engagement with a connector on the upper extremity 138 of the right side actuator plate 106. The cables 110 and 112 thus cross and operate under tension in response to turning of either handle in the vertical plane as will be further explained below.

With this construction, when handle 28 is moved from the full line position to the phantom line position in FIG. 2, the actuator plate 30 is correspondingly moved to its phantom line position. The pivot 46 aligned with pivot 60 allows the yoke 42 to be turned during this action without actuation of rod 48. Since the cable 110 and 112 and interconnect the actuator plates 30 and 106, both are turned on their pivots to simultaneously actuate and lock the locks 16 and 18 of the right and left doors. By moving handle 28 from the phantom line position to the full line position, actuator plate 30 is turned on pivot 70 to its original station and cable 110, under tension, rotates actuator plate 106 back to the illustrated position. Under such conditions both doors will unlocked. While rotation of either the left or right side handle in the vertical plane will control the locking function of both door closure locks 16 and 18, the door latch controls are independent of one another. For example, when right side handle 28 is moved to the unlatched position of FIG. 3, the left side handle assembly is not actuated so that the left side door is not unlatched. Conversely when the left side handle is moved to unlatch its door, the right side handle assembly is not actuated and the right side door remains latched.

Instead of employing a pair of cables such as cables 110 and 112, a single Bowden cable acting in tension and compression may be readily employed. If desired, the latching of the handle assembly may be eliminated in some modifications of this control. Under such circumstances, the remote handles may be rigidly secured to their respective actuator plates with pivots such as pivot 32 eliminated. The latch control would be through another suitable handle or lever mechanism spaced from the lock control handle.

The detailed description and illustrations of the preferred embodiments of this invention for the purpose of explaining the principles thereof are not to be considered as limiting or restricting the invention since many modifications may be made by the exercise of skill in the art without departing from the scope of the invention as set forth in the following claims.

What is claimed is:

1. In combination with a vehicle door hinged to a vehicle body and movable between fully opened and closed positions with respect to said body, a door lock operatively supported by said door, said door lock having latching lever means operable to unlatch said door so that it can be moved from said closed position, said door lock further having locking lever means operable to lock said door in said closed position and to unlock said door so that it can be unlatched and subsequently moved from said closed position, the improvement comprising a remote control handle assembly mounted on the interior of said door in a position spaced from said door lock, said handle assembly comprising a manual handle and an actuator plate, pivot means mounting said actuator plate on said door for turning movement in a first plane for actuation of said locking lever means, pivot means mounting said manual handle on said actuator plate for turning movement independent of said actuator plate in a second plane for actuation of said latching lever means and to permit said actuator plate to be turned by said manual handle in said first plane, first connector means interconnecting said actuator plate with said locking lever means so that said manual handle can be turned to turn said actuator plate in said first plane to thereby control the locking and unlocking of said door, second connector means interconnecting one end of said manual handle to said latching lever means so that said manual handle can be turned in said second plane for the unlatching of said door to thereby permit said door to be moved from its closed positon to an open position.

2. In combination with a vehicle door hinged to a vehicle body and moveable fully opened and closed positions with respect to said body, a door lock operatively supported by said door, said door lock having latching lever means operable to unlatch said door so that it can be moved from said closed position, said door lock further having locking lever means operable to lock said door in said closed position and to unlock said door so that it can be subsequently unlatched and moved from said closed position the improvement comprising a remote control handle assembly mounted on the interior of said door in a position spaced from said door lock, said handle assembly comprising a manual handle and an actuator plate, first pivot means mounting said actuator plate on said door for turning movement in a first plane for actuation of said locking lever means, second pivot means mounting said manual handle on said actuator plate for turning movement independent of said actuator plate in a second plane and to permit said actuator plate to be turned by said manual handle in said first plane, first connector means interconnecting said actuator plate with said locking lever means so that said manual handle can be turned ot turn said actuator plate in said first plane to thereby control the locking and unlocking of said door, second connector means interconnecting one end of said manual handle to said latching lever means so that said manual handle can be turned in said second plane for the unlatching of said door to thereby permit said door to be moved from its closed position to an open position, and third pivot means axially aligned with said first pivot means operatively disposed in said second connector means to permit said actuator plate to be turned by said handle means in said first plane to actuate said locking lever means without actuating said first connector means and said latching lever means.

3. In combination in a vehicle body having a pair of spaced doors movable between fully opened and closed position with respect to said body, a door closure lock having latching and locking functions and operatively mounted in each of said door, each of said door locks having first operator means controlling the unlatching function thereof and further having second operator means controlling the locking function of said lock, the improvement comprising a remote control handle assembly mounted on the interior of each of said doors in a position spaced from the respective door closure lock thereof, each said handle assembly comprising an actuator plate mounted for turning movement in a first plane for actuation of said second operator means and a manual handle mounted on each said actuator plate for turning the associated actuator plate and mounted for turning movement in a second plane for actuating said first operator means, connector means interconnecting said actuator plates of each of said doors with each other so that either of said manual handles can be turned in one direction in said first plane to cause the locking of both of said doors and turned in an opposite direction in said first plane to cause the unlocking of both of said doors, connector means interconnecting one end of each of said handles to said respective first operator means to permit said handle to effect the unlatching of the associated door without unlatching the door remote therefrom to thereby permit said unlatched door to be moved from its closed position to an open position.

4. In combination with a vehicle body having a pair of spaced doors each movable between fully opened and closed positions with respect to said body, a door lock operatively mounted in each said doors, each said door lock having lever means for controlling the locking and unlocking function thereof the improvement comprising a remote handle assembly mounted on the interior of each of said doors in a position spaced from said associated door lock, each said remote handle assemblies comprising support plate means secured to said associated door and an actuator plate movably mounted on said support plate means for actuation of said locking lever means, a handle mounted on said each actuator plate for turning said actuator plate, cable means connecting said actuator plates to each other so that said handle means of either of said handle assemblies will actuate said door closure lock of both of said doors.

5. In combination with a pair of spaced vehicle doors hinged to a vehicle body and movable between fully opened and closed positiones with respect to said body, a door lock operatively mounted in each of said doors, each of said door locks having locking lever means operable to lock said door in said closed position and to unlock said door so that it can be moved from said closed position the improvement comprising, a remote control handle assembly mounted on the interior of each of said doors in a position spaced from said associated door lock, each said handle assembly comprising an actuator plate mounted on said door for turning movement for actuation of said associated locking lever means and a manual handle mounted on said actuator plate for turning said actuator plate, cable means interconnecting said actuator plates with each other so that either of said handle means can be turned to turn said actuator plates to simultaneously control the locking and unlocking of said pair of doors.

* * * * *

UNITED STATES PATENT OFFICE

CERTIFICATE OF CORRECTION

Patent No. 4,054,307 Dated October 18, 1977

Inventor(s) Richard F. Carella and Thomas W. Perry

It is certified that error appears in the above-identified patent and that said Letters Patent are hereby corrected as shown below:

Column 1, line 26, after "body" delete "of" and insert -- is -- .

Column 1, line 40, "inorpo" should read -- incorpo -- .

Column 1, line 44, "door" should read -- doors -- .

Column 3, line 5, "onto" should read -- into -- .

Column 4, line 22, after "112" delete "and".

Column 4, line 30, after "will" insert -- be -- .

Column 5, line 22, after "movable" insert -- between -- .

Column 5, line 43, "ot" should read -- to -- .

Column 6, line 44, "positiones" should read -- positions -- .

Signed and Sealed this

Sixteenth Day of May 1978

[SEAL]

Attest:

RUTH C. MASON
Attesting Officer

LUTRELLE F. PARKER
Acting Commissioner of Patents and Trademarks